US005703442A

United States Patent [19]

Notohamiprodjo et al.

[11] Patent Number: 5,703,442

[45] Date of Patent: Dec. 30, 1997

[54] METHOD AND APPARATUS FOR INTERFACING A LIGHT DIMMING CONTROL WITH AN AUTOMATED CONTROL SYSTEM

[75] Inventors: Hubertus Notohamiprodjo, Union City; Kata Kukiatsakulchai, San Fancisco, both of Calif.

[73] Assignee: Electronic Lighting Incorporated, Menlo Park, Calif.

[21] Appl. No.: 638,788

[22] Filed: Apr. 29, 1996

[51] Int. Cl.[6] ..... G05F 1/00

[52] U.S. Cl. ..... 315/307; 315/295; 315/159; 315/DIG. 4

[58] Field of Search ..... 315/159, 149, 315/154, 158, 295, 301, 307, DIG. 4; 307/100, 132 E, 141; 364/132, 492

[56] References Cited

U.S. PATENT DOCUMENTS 4,292,570 9/1981 Engel ..... 315/360
4,461,977 7/1984 Pierpoint et al. ..... 315/159
5,357,170 10/1994 Luchaco et al. ..... 315/159
5,455,490 10/1995 Callahan et al. ..... 315/194
5,463,286 10/1995 D'Aleo et al. ..... 315/295
5,485,057 1/1996 Smallwood et al. ..... 315/58
5,530,322 6/1996 Ference et al. ..... 315/295

*Primary Examiner*—Robert Pascal
*Assistant Examiner*—Haissa Philogene
*Attorney, Agent, or Firm*—Burns, Doane, Swecker, & Mathis, L.L.P.

[57] ABSTRACT

The present invention is directed to providing building automation systems which can effectively control light output of a building in a manner which can significantly reduce power consumption, yet which goes virtually unnoticed by building occupants. Exemplary embodiments are directed to using existing building automation systems to control the dimming, rather than the turning off, of selected artificial lighting. Further, exemplary embodiments are directed to using the conventional relay network of existing building automation systems to control the dimming of the artificial lighting.

16 Claims, 2 Drawing Sheets

METHOD AND APPARATUS FOR INTERFACING A LIGHT DIMMING CONTROL WITH AN AUTOMATED CONTROL SYSTEM

BACKGROUND OF THE INVENTION

1. Field of the Invention

The present invention relates generally to automated energy control systems. More particularly, the present invention relates to an apparatus and method for interfacing dimming controllable devices with an automated energy control system.

2. State of the Art

Automated control systems, such as building energy management systems or building automation systems (collectively designated herein as building automation systems, or "BAS") are known. These computerized systems continuously monitor the conditions of a designated area, such as the conditions of a building, to manage overall power consumption. For example, these systems monitor parameters which reflect building conditions, in terms of power consumption, power quality (e.g., power factor), temperatures for human comfort, hot water temperature and so forth.

The evolution of building automation systems stemmed primarily from maximum peak power limitations imposed by power utility companies during periods of peak customer demand, such as during the course of a business day. To maintain peak demand within acceptable limits while minimizing across the board restrictions or arbitrary cutbacks on one or more of their customers, power utility companies have shifted the burden of deciding how best to manage available energy to their customers. For example, each power consumer of the power utility company, such as a particular building, is attributed a peak power limit allowed by the utility company during the business day. When the power consumption of that building exceeds the peak power limit a single time, the power utility company imposes significant penalty charges on that consumer for the entire month. To avoid these significant penalty charges, building managers often invest in building automation systems for controlling their peak demand without producing noticeable affects on the building operation as perceived by occupants of the building.

Typically, building automation systems, in the simplest case, use a processor to monitor power consumption. When power consumption approaches the peak power limit specified for the building, the processor cyclically turns various energy consumption components of the building on and off in a manner which goes virtually unnoticed by building's occupants. For example, when power consumption approaches the peak power limit specified for the building, the processor is typically used to control the heat-ventilation-air conditioning (HVAC) system by, for example, cyclically turning off the heat or air conditioning within the multiple zones of the building, or by cyclically turning off components, such as a boiler or hot water heater, in rotation from one zone to another within the building.

To achieve the cyclical control among the multiple zones, building automation systems typically include a central processor which responds to the detection of specified events to control particular relay contacts of a relay network. The relay contacts, when activated, turn "on" or "off" a particular component being controlled. Typically, a single relay is used to control all components within a given zone of a building, such that activation of the relay would result in a larger number of components being switched off than would be necessary to reduce power consumption within an acceptable range. Although such a situation could be addressed by increasing the number of relays (e.g., providing a relay for each component), this solution is impractical in reality, since it would significantly increase the cost of implementing any such system, particularly in larger buildings.

Building lighting is typically not affected by the building automation system because of the impact that such control would have on the building occupants. However, as a last resort, some provision is often incorporated within building automation systems to turn off lights in predetermined zones, such as the basement, only if peak power cannot be maintained below the specified peak power limit by turning off components which produce less noticeable effects.

Because of the impact which turning off artificial lighting would have on building occupants, building automation systems have not focused on the control of artificial light output to maintain power consumption within the peak power limits specified by the power utility companies. However, artificial lighting can be a significant percentage of power consumption within any building, such as on the order of 20 to 25% or greater at any given time. Artificial lighting also has side effects which drive the overall power consumption of a building even higher. For example, the heat generated by artificial lighting places additional strain on the air conditioning system of a building, a problem which is only further aggravated when the building automation system cuts back on air conditioning output to reduce power consumption during periods of peak demand.

As power consumption demands steadily increase, the power utility companies are forced to lower the peak power limits imposed on customers. As a result, the effects of power conservation during periods of peak demand become much more noticeable to building occupants. For example, reduced limits result in more frequent cycling among the HVAC zones and/or the boiler or hot water zones. This control results in temperature conditions which are increasingly more noticeable to occupants (e.g., a climate or water temperature which is noticeably cooler or warmer than desired).

Accordingly, it would be desirable to provide building automation systems which can more effectively control light output to reduce power consumption in an effort to satisfy peak demand limits without affecting building operating characteristics in a manner which is noticeable to the building occupants.

SUMMARY OF THE INVENTION

The present invention is directed to providing building automation systems which can effectively control light output of a building in a manner which can significantly reduce power consumption, yet which goes virtually unnoticed by building occupants. Exemplary embodiments are directed to using existing building automation systems to control the dimming, rather than the turning off, of selected artificial lighting. Further, exemplary embodiments are directed to using the conventional relay network of existing building automation systems to control the dimming of the artificial lighting.

In accordance with specific exemplary embodiments, a dimming interface is provided whereby the relay network of a building automation system can be interfaced to ballasts used in conjunction with negative resistance loads (such as fluorescent lamps) and/or with incandescent light bulbs to control dimming of the light output. The dimming of the artificial light output from the lamps is achieved at a relatively slow rate which is virtually undetectable by building occupants. In addition to providing the advantage of reducing power consumption in a manner which is virtually undetectable by building occupants, an additional advantage is that more accurate tuning of the actual decrease in power consumption can be achieved. That is, by providing a dimming function to reduce power consumption, the amount of dimming which is performed can be adjusted without requiring the turning off of devices which would be unnecessary to satisfy peak power limits.

Generally speaking, exemplary embodiments of the present invention are directed to an apparatus for interfacing a lighting system with an automated energy control system comprising: means for receiving energy control signals from an automated energy control system; and means for converting said energy control signals from said receiving means into lamp intensity control signals to control lamp intensity of at least one light output device of a lighting system in response to a power consumption monitored by the automated energy control system.

BRIEF DESCRIPTION OF THE DRAWINGS

The present invention can be further understood with reference to the following description and the appended drawings, wherein like elements are provided with the same reference numerals. In the drawings.

DETAILED DESCRIPTION OF THE PREFERRED EMBODIMENTS

Figure 1:
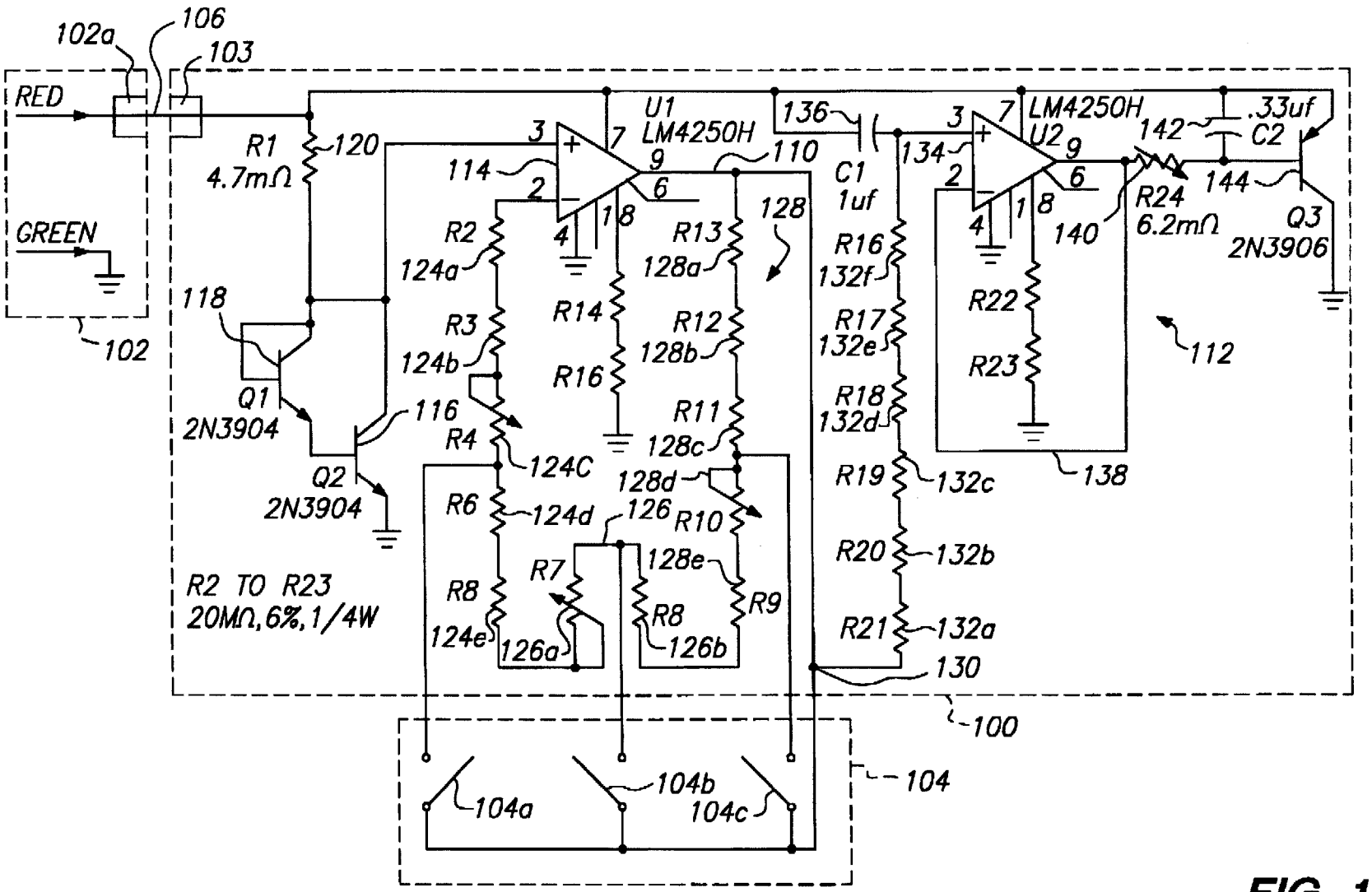
FIG. 1 is an apparatus for interfacing a lighting system with an automated energy control system in accordance with an exemplary embodiment of the present invention.

FIG. 1 illustrates an apparatus for interfacing a lighting system 102 with an automated energy control system 104, the apparatus being generally designated as interface circuit 100. For purposes of the following discussion, the interface apparatus is described for use with a lighting system 102 which includes one or more light output devices constituted by negative resistance loads, such as fluorescent lights having continuous dimming controllable electronic ballasts. The interface device controls the light intensity of the light output devices in response to an input signal from the automated energy control system. In accordance with exemplary embodiments, the power consumption of the lighting system is reduced by a number of incremental, predetermined, adjustable levels. By reducing the light output of the lighting system at a very slow rate, changes in light output can be implemented which are virtually imperceptible to the human eye.

The use of fluorescent lights which include continuous dimming controllable electronic ballasts pose additional problems for use in conjunction with automated energy control systems, since conventional dimming ballasts typically include analog dimming controls (e.g., responsive to analog voltage ranges of, for example, 0 to 10 volts or greater). Such dimming controllable electronic ballasts are not compatible with communications protocols of typical automated energy control systems wherein cyclic on/off control is achieved using a relay network, as mentioned previously. For example, in an exemplary building application, conventional automated energy control systems control each floor as a separate zone (e.g., a separate zone of the HVAC system), and a relay is provided to cyclically turn each such zone on or off.

In contrast, in accordance with exemplary embodiments of the present invention, rather than using the multiple relays of an automated energy control system to cyclically switch the controllable zones of a building on or off, the relays are used to designate one of multiple levels of lamp output intensity for the entire lighting system, or for predesignated groups of light output devices. In this regard, no additional overhead is required when retrofitting an automated energy control system of a building with an ability to dim the lighting system in accordance with exemplary embodiments of the present invention. Rather, any relays which would have been previously used to cyclically switch various zones of the lighting system on and off are used to establish one of multiple incremental lamp intensity outputs for the entire lighting system.

In the exemplary FIG. 1 embodiment, three of the relays which might have been previously used to control three different zones of the lighting system (i.e., either to switch the zones on or off) are now used to establish one of three different intensity levels for the entire lighting system of the building, or for a selected group of light output devices in the building. The three relays are designated 104*a*, 104*b* and 104*c* in the exemplary FIG. 1 embodiment.

For purposes of simplifying the following discussion, the lighting system 102 will be considered a single continuous dimming controllable electronic ballast of a negative resistance load. A signal path 106 for interconnecting the interface apparatus 100 with the lighting system 102 varies, in accordance with this exemplary embodiment, from 0 to 10 volts to adjust the output intensity of the lamp in accordance with dimming control specifications of the lamp.

To control the intensity of light output devices in the lighting system 102 via signal path 106, the exemplary FIG. 1 embodiment includes means for receiving energy control signals from an automated energy control system, generally represented by the control signals which are produced upon the closing of any one or more of the relays 104*a*–104*c*. Further, the exemplary FIG. 1 embodiment includes means for converting these control signals into lamp intensity control signals to control lamp intensity of at least one light output device, generally represented in FIG. 1 as the interface circuit 100 which supplies a lamp intensity control signal to the dimming controllable electronic ballast. As mentioned previously, the exemplary FIG. 1 interface circuit outputs lamp intensity control signals varying from 0 to 10 volts, to control lamp intensity in response to a power consumption monitored by the automated energy control system.

As those skilled in the art will appreciate, any readily available automated energy control system can be used in accordance with the present invention. For example, one such automated energy control system which is used to control the relay contacts in a manner as discussed previously is the Square D POWERLINK™ System available from Square D of Smyrna, Tenn. In the exemplary FIG. 1 embodiment, the intensity control signals are provided to the dimming ballast to thereby dim the output lamp intensity in multiple increments based on overall peak power demand of the system being monitored by such an automated energy control system.

The actual amount of dimming which is performed in response to the automated energy control system can be decided in any known fashion. For example, using conventional automated energy control systems such as the Square D system mentioned above, comparison of peak power associated with total power consumption of a building can be compared against a peak power limit value. When the peak power of the power consumption in the building falls within a set threshold range of the peak power limit, a first relay can be closed to decrease lamp intensity by a first incremental value. Similarly, if the peak power of power consumption within the building exceeds a second threshold which is in closer proximity to the peak power limit than the first threshold, a second of the relays can be actuated to decrease lamp intensity by a second incremental value. This process can be repeated any number of times, in accordance with the number of relays provided for establishing incremental values with which lamp intensity can be decreased.

The operation of dimming is performed at a relatively slow rate such that occupants will be unaware of the decrease in lamp intensity. The dimming is provided in a manner which preserves sufficient light that occupants are unaware of any dimming control, and because of the decreased heat output from the lighting system, in many cases, it is unnecessary to perform additional power conservation such as by turning off the heating or air conditioning system or water heaters. However, as those skilled in the art will appreciate, a dimming of the lighting system, either in total or by zones, according to exemplary embodiments of the present invention, can be used in conjunction with conventional power conservation implemented using known automated energy control systems (e.g., by dimming lights in addition to cyclically controlling the HVAC system).

In accordance with exemplary embodiments, the interface circuit 100 is connected to the lighting system 102 via one or more RJ11 telephone connectors 102*a* and/or 103 to provide easy and error-free installation. The interface circuit can be configured as a simple terminal block which interfaces the relay output(s) of any available energy control system. In accordance with exemplary embodiments, the energy control signals can be generated in response to programming of the automated energy control system computer, manually induced or controlled remotely, for example, by the local power utility company.

The interface circuit includes two stages in the exemplary FIG. 1 embodiment. A first stage in the interface circuit is labelled 110, and is used to produce a stable reference voltage for use by the second stage. The production of a stable reference voltage is desirable, since the supply voltage derived from signal path 106 will vary in response to voltages applied across this path. The second stage of the interface circuit labelled 112 is used to provide a time delay for the dimming operation of the lighting system. That is, each time an incremental change in the lamp voltage is to be initiated by the first stage (e.g., a change in voltage from 10 volts to 8 volts to produce a decrease in lamp output), this two volt change is implemented by a delay circuit so that a sharp transition does not occur from the initial voltage to the final voltage, but rather is transitioned over a period of time (e.g., on the order of several minutes). Each of the first and second stages will now be discussed in turn.

In the first stage 110, an amplifier/comparator is provided in the form of an operational amplifier 114. A non-inverting input of the operational amplifier 114 is connected to a pair of transistors 116 and 118 which are used to produce a stable reference voltage for the operational amplifier 114. More particularly, the non-inverting input is connected to the collector of n-channel transistor 116 (e.g., a transistor such as a transistor 2N3904, available from Motorola, Inc.). The base of the transistor 116 is connected to the emitter of a similar n-channel transistor 118, whose base is tied to its collector. The collectors of the transistors 116 and 118 are also connected via a resistor 120 (e.g., 4.7 megaohms) to the signal path 106.

The inverting input of the operational amplifier 114 is connected to the output of operational amplifier 114 via a feedback path which includes a resistor divider network 122 for implementing varying degrees of dimming based on energy control signals from the automated energy control system. More particularly, the resistor divider network includes three separate voltage dividers 124, 126 and 128, respectively. The first voltage divider 124 includes resistors 124*a*–124*e*, at least one of which is a variable resistor (i.e., the resistor 124*c* in the exemplary FIG. 1 embodiment). In accordance with an exemplary embodiment, each of these resistors can be considered approximately 20 megaohm resistors. The second voltage divider 126 includes a variable resistor 126*a* and a fixed resistor 126*b*. The third voltage divider includes resistors 128*a*–128*e*, of which resistor 128*d* is a variable resistor. In accordance with exemplary embodiment, each of the resistors in the second and third voltage dividers 124 and 126 can also be considered 20 megaohm resistors.

To provide a voltage divider function in response to the energy control signals from the automated energy control system, the relay contacts 104*a* are connected at the junction between series connected resistors 124*c* and 124*d*. The relay contacts 104b are connected at a series junction point between the resistors 126*a* and 126*b* of the second voltage divider 126. Similarly, the relay contacts 104*c* are connected to a junction between the series connected resistors 128*c* and 128*d* of the third voltage divider. As will be apparent to those skilled in the art, the closing of any of the relay contacts 104*a*–104*c* can be used to short circuit at least a portion of the feedback resistance of the first operational amplifier 114, and thereby control the voltage output from this operational amplifier at an output node 130.

The output node 130 supplies an output voltage via a resistance represented in the exemplary FIG. 1 embodiment as a combination of 6 resistors 132*a*–132*f* to a second stage 112. The use of multiple resistors allows a single resistor value to be used for all of the resistors in the exemplary FIG. 1 embodiment. For example, as with the resistors of the voltage dividers, the output resistors 132 connected to node 130 can each be 20 megohms.

As mentioned previously, those skilled in the art will appreciate that any number of incremental adjustments in the lamp intensity can be provided by increasing the number of voltage dividers and associated relays in the exemplary FIG. 1 embodiment. Each of the voltage dividers in the exemplary FIG. 1 embodiment can be individually adjusted by the variable resistor included therein. The variable resistor in each voltage divider can, for example, be controlled by an end user interface for setting a power level reduction which will be initiated in response to activation of the relay contacts associated with that voltage divider.

Turning now to the second stage 112, it will be apparent to those skilled in the art that this stage implements a time delay function in transitioning from an initial voltage of the output from the first stage to a final voltage. This gradual transition in voltage is applied to the signal path 106 used to control lamp output intensity of the lighting system 102.

The second stage 112 includes an operational amplifier 134. A non-inverting input of the operational amplifier 134 is connected to the output node 130 of the first stage via the resistors 132*a*–132*f*. Further, the non-inverting input of operational amplifier 134 is connected to the signal path 106 via a capacitor 136 (e.g., 1 microfarad). This capacitor is used in conjunction with resistors 132a–132f to establish a time delay for voltage transitions at the input to operational amplifier 134.

The inverting input of the operational amplifier 134 is connected to the output of the operational amplifier 134 via the feedback path 138. The output of the operational amplifier 134 is connected through a delay circuit represented as a resistor-capacitor (i.e., RC) circuit which includes variable resistor 140 (e.g., on the order of 6.2 megohms) and a capacitor 142 (e.g., on the order of 0.33 microfarads). A junction between the RC circuit is connected to the base of a p-channel transistor 144 (e.g., a transistor 2N3906 available from Motorola, Inc. or a transistor MPSW51, also available from Motorola, Inc.). The emitter of transistor 144 is connected to the signal path 106, while the collector of this transistor is connected to ground to dissipate current from the ballast during a dimming mode of operation (e.g., up to 450 milliamps, or greater).

The p-channel transistor 144 constitutes a power transistor which can thus be used to sink the current from one or more ballasts of the lighting system. For example, the p-channel transistor shown can, for example, sink excess current from a number of ballasts, ranging up to 1000 ballasts or greater. As those skilled in the art will appreciate, when the voltage supplied across signal path 106 is decreased from 10 volts to initiate a dimming function, it is necessary to dissipate the excess current. The ability to dissipate this excess current becomes more significant as the control voltage on signal path 106 approaches 0 volts (i.e., a maximum dimming condition).

As those skilled in the art will appreciate, the emitter-collector voltage of transistor 144 will follow the base-emitter voltage of this transistor which, in turn, corresponds to the voltage output from the operational amplifier 114. That is, a decrease in the output voltage from the operational amplifier 114 from, for example, 10 volts to 8 volts, will ultimately result in a decrease of the emitter-collector voltage of transistor 144 (i.e., after the capacitor 142 has discharged to a level of 8 volts).

In operation, the interface protocol of the exemplary lighting system 102 is 0 to 10 volts DC. At 0 volts input, the ballast limits power so that the lamp intensity output is at a minimum value. In contrast, at 10 volts input, the lamp output intensity is at a maximum value. Between 0 and 10 volts, the ballast will dim the lamp output intensity between the maximum light output and the minimum light output. Thus, in operation, as power consumption of the system controlled by the automated energy controlled system is increased to a vicinity of the thresholds associated with the peak power limit, one or more of the relay contacts 104a–104c will close.

Note that when none of the relay contacts are closed, the feedback path of the operational amplifier 114 includes all of the voltage divider networks 124, 126 and 128. Thus, by closing one or more of the relay contacts 104a–104c, a portion of the resistive feedback path is short circuited, thereby lowering the resistance of the feedback path associated with operational amplifier 114 and decreasing the gain. The closing of one or more of the relay contacts 104a–104c will therefore have the effect of reducing the magnitude of the voltage present at node 130. This reduced voltage will, following the delay associated with the second stage 112, reduce the voltage supplied to the ballast across signal path 106, thereby dimming the lamp output.

The human eye responds to changing levels of ambient light by continuously adjusting the pupil to compensate for differences which are either higher or lower than normal. Accordingly, when light is slowly dimmed from between, for example, 0 to 15% over a time period of two to five minutes, the human eye will not notice the difference in intensity due to self-adjustment capabilities of the human eye. Exemplary embodiments of the interface apparatus thus exploit this self-adjustment characteristic of the human eye to reduce power consumption by incrementally dimming the lamp output intensity of lamps included in the lighting system in response to energy control signals from an automated energy control systems.

Exemplary embodiments as illustrated in FIG. 1 normally operate without a separate power supply input. However, those skilled in the art will appreciate that in alternate embodiments, an ability of the ballast included in the lighting system 102 to supply current (e.g., 450 microampers) via the use of an additional power supply, can be implemented.

Those skilled in the art will appreciate that the two stages of amplifier/comparator functionality are provided using low power complementary metal oxide semiconductor (CMOS) integrated circuits to form operational amplifiers 114 and 134. In accordance with an exemplary embodiment, the operational amplifiers can be LM4250H operational amplifiers available from National Semiconductor, Inc., or can be TL25L2CP operational amplifiers available from Texas Instruments, Inc., or any other operational amplifiers. The foregoing named amplifiers are low power CMOS devices which are well suited to the embodiment illustrated in FIG. 1. Of course, those skilled in the art will appreciate that any number of amplifier/comparator sections can be used in conjunction with any available integrated circuit technology.

Figure 2:
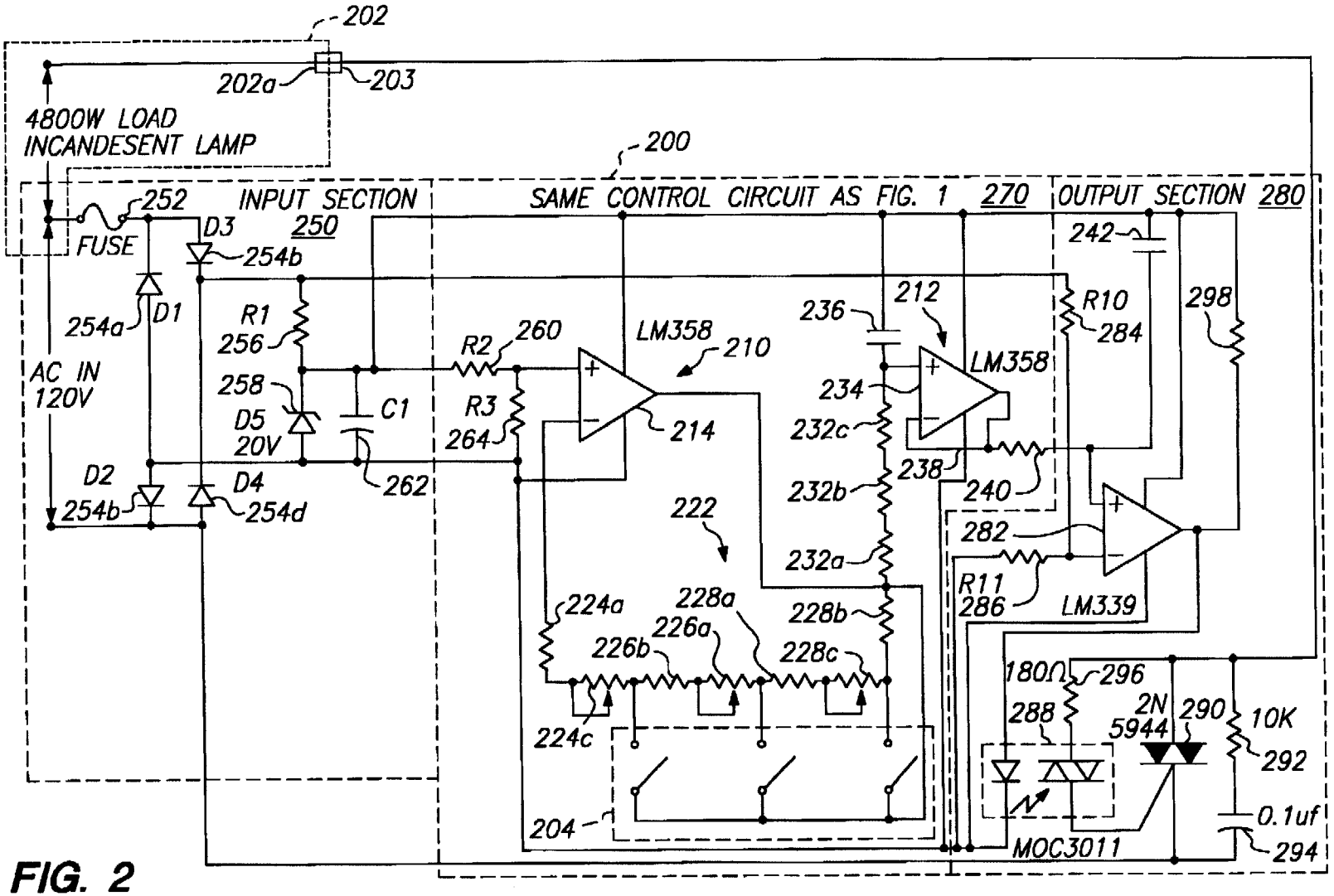
FIG. 2 is an alternate exemplary embodiment of the present invention for use with an incandescent lighting system.

As mentioned previously, the present invention is not limited to use with a dimming ballast and a negative resistance load (such as fluorescent lamps). Rather, exemplary embodiments of the present invention can be configured with respect to any lighting system. For example, FIG. 2 illustrates an alternate exemplary embodiment of the present invention wherein a lighting system is configured with incandescent lamps. Although operation of the exemplary FIG. 2 embodiment is similar to that of the exemplary FIG. 1 embodiment, a more detailed discussion of features included in FIG. 2 will be provided.

In the exemplary FIG. 2 embodiment, the lighting system 202 includes one or more light output devices constituted by incandescent lamps. In the example illustrated, the incandescent lamps constitute a load of up to 4800 watts (e.g., 80 incandescent light bulbs at 60 watts each), or greater. In accordance with exemplary embodiments, the automated energy control system, generally depicted as 204, can be considered identical to that used in conjunction with the exemplary FIG. 1 embodiment.

The apparatus for interfacing the lighting system 202 with the automated energy control system 204 is generally designated as interface circuit 200. Although the principle of operation associated with the exemplary FIG. 2 embodiment is the same as that applicable to the exemplary FIG. 1 embodiment, the input and output sections of the interface circuit 200 have been slightly modified relative to comparable sections of the exemplary FIG. 1 embodiment. For purposes of simplifying the following discussion, components providing functions similar to those of components in the FIG. 1 embodiment are labeled with numbers used in the FIG. 1 embodiment, but incremented by a value of 100. Accordingly, the discussion of FIG. 2 will focus primarily on the differences between the FIG. 1 and FIG. 2 embodiments.

In the exemplary FIG. 2 embodiment, an input section 250 is provided with AC voltage at 120 volts root-mean-square (i.e., $V_{rms}$). The input section 250 includes an optional series connected fuse 252. Connected between the AC power supply and a diode bridge configured using diodes 254*a*–254*d*, for rectifying the AC input voltage. The output from the rectifier bridge is supplied across a series connected resistor 256 and a Zener diode 258. The Zener diode effectively steps the voltage down to 20 volts. Thus, the input section produces a voltage source for powering the remaining portions of the interface circuit and for providing a reference voltage using a resistor divider formed by resistors 260 and 264. Capacitor 262 is provided as a filtering capacitor for the voltage reference.

The voltage reference serves as an input to a control circuit portion 270 of the interface circuit 200. This control circuit portion can be considered to function in a manner similar to that of the control circuit portion in FIG. 1. However, those skilled in the art will appreciate that the exemplary FIG. 2 embodiment can be configured with operational amplifiers and component values suitable for use with an incandescent lighting system. For example, rather than using the operational amplifier specified with respect to the FIG. 1 embodiment, operational amplifiers, such as LM358 operational amplifiers available from National Semiconductor, Inc. can be used. Again, these operational amplifiers are low power operational amplifiers suitable for use in the control circuit portion illustrated in FIG. 2.

Turning now to output section 280 of the interface circuit, the output of the delay operational amplifier 234 serves as a dimming control reference voltage to an operational amplifier 282 which functions as a comparator. The operational amplifier 282 can, for example, be configured using an LM339 operational amplifier available from National Semiconductor, Inc. The operational amplifier 282 compares the dimming control reference voltage from the control circuit portion 270 of the interface circuit to the stepped down, full wave rectified AC signal from a voltage divider formed by resistors 284 and 286.

In operation, whenever the rectified AC signal level is equal to the dimming control reference voltage, an optocoupler 288 (e.g., an MOC3011 optocoupler available from Motorola, Inc.) is switched off. As a result, a power triac 290 is turned off (the triac 290 can, for example, be a 2N5944 triac available from Motorola, Inc.). In contrast, when the rectified AC signal from the control circuit portion of the interface circuit is less than the dimming control reference voltage, the optocoupler 288 turns on, which turns on the power triac 290 as well.

In accordance with exemplary embodiments where the AC supply is a 60 hertz supply, the full wave rectified signal will have a frequency of 120 hertz, such that the comparator 282 will generate the dimming control reference signal as a pulsed signal to the power triac at a frequency of 120 hertz. The pulse width of this signal is determined by the magnitude of the dimming control reference voltage with which the AC signal is compared, the dimming control reference voltage in turn being controlled as a function of the relay contacts in the automated energy control system 204.

The output section 280 of the FIG. 2 embodiment further includes a resistor 292 (e.g., 10 kilo-ohms) and a capacitor 294 (e.g., 0.1 microfarads). Further, a resistor 296 (e.g., 180 ohms) is connected in series with the optocoupler between an output of the triac and the gate of the triac. A resistor 298 can also be included in series with the light emitting diode of the optocoupler 288.

The voltage divider established by resistors 284 and 286 can be set such that when all of the relays contacts of the automated energy control system 204 are open, a peak of the AC signal is a set value (e.g., 10 millivolts) less than the dimming control reference voltage to produce an output which maintains the optocoupler in a conducting state. As such, the power triac 290 is maintained in an on condition, which translates to a maximum light condition for the incandescent light output devices of the lighting system 202. In contrast, when one or more of the relay contacts in the automated energy control system 204 is closed, the dimming control reference voltage is lowered accordingly. Thus, the peak of the AC signal will become greater than the reference voltage, such that the output of the optocoupler 288 will be turned off for a period which depends on the magnitude by which the dimming control reference voltage has been reduced. Consequently, the pulses produced at 120 hertz by the power triac 290 will be of reduced width, such that the incandescent lamps of the lighting system 202 will dim.

As the "off" portion associated with each pulse in the pulsed signal used to drive the power triac 290 widens, the lamp output devices of the lighting system will dim even further. As with the exemplary FIG. 1 embodiment, the amount of dimming produced in response to the closing of each set of relay contacts can be set by the user. Further, the incremental dimming achieved between the closing of each successive set of resistors can be controlled by increasing or decreasing the number of resistors in the feedback path of the operational amplifier 214.

As those skilled in the art will appreciate, the lamp output devices of the lighting system are continuously turned on and off at a rate of 120 hertz. Because of the rapid rate with which the tuning on and off of the lamps occurs, the human eye is incapable of detecting the flicker which occurs in the output from the lamp output devices. Rather, the human eye perceives the lamps as operating with reduced power output (i.e., the human eye perceives a dimming affect). As the lamp output devices are dimmed, the power consumption of the lighting system is lowered in proportion to the dimming level. For example, if the lighting system is dimmed to seventy percent of its maximum output value, where the lamp output devices are 60 watt light bulbs, the lighting system will consume only 42 watts in power for the exemplary embodiment illustrated in FIG. 2. Of course, with different systems, the actual power conservation achieved by a dimming function can be set to any desired level.

In the foregoing exemplary FIG. 2 embodiment, the use of incandescent lamp output devices was described. In contrast, the exemplary FIG. 1 embodiment was described with respect to fluorescent lamps. However, those skilled in the art will appreciate that in accordance with exemplary embodiments, any combination of fluorescent and incandescent lamp output devices can be used, and that any other available lamp output devices can be used in conjunction with any of the lamp output devices described with respect to FIGS. 1 and 2.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Apparatus for interfacing a lighting system with an automated energy control system comprising:

means for receiving energy control signals from an automated energy control system; and means for converting said energy control signals from said receiving means into lamp intensity control signals to control lamp intensity of at least one light output device of a lighting system in response to a power consumption monitored by the automated energy control system, wherein said converting means includes at least one amplifier stage, said amplifier stage having a feedback path which includes a variable resistance.

2. Apparatus according to claim 1, wherein said receiving means includes at least one relay having relay contacts.

3. Apparatus according to claim 2, wherein said relay contacts are used to short circuit at least a portion of the variable resistance included in said feedback path of said amplifier stage.

4. Apparatus according to claim 3, wherein said at least one amplifier stage is supplied power from a signal path used to control said lamp intensity.

5. Apparatus according to claim 4, wherein said converting means includes at least one transistor as an input to said at least one amplifier stage, said at least one transistor establishing a reference voltage for said at least one amplifier stage.

6. Apparatus according to claim 1, wherein said convening means includes at least one additional amplifier stage for receiving an output from said at least one amplifier stage.

7. Apparatus according to claim 6, wherein said at least one additional amplifier stage provides a delay function.

8. Apparatus according to claim 7, wherein said at least one additional amplifier stage includes an RC circuit.

9. Apparatus according to claim 8, wherein said at least one additional amplifier stage includes at least one transistor connected between an output of said at least one amplifier stage and a signal path used to control said lamp intensity.

10. Apparatus according to claim 1, wherein said converting means includes at least one RJ11 connector.

11. Apparatus according to claim 1, wherein said at least one amplifier stage is formed as a low power CMOS operational amplifier.

12. Apparatus according to claim 6, wherein said at least one amplifier stage and said at least one additional amplifier stage are formed using low power CMOS operational amplifiers.

13. Apparatus according to claim 1, wherein said converting means further includes:

a switching device which is gated by a pulsed signal having a pulse width proportional to a desired dimming of said lighting system.

14. Apparatus according to claim 13, wherein said converting means further includes:

a power input section having a rectifier bridge and a Zener diode for stepping down an AC input voltage to a DC voltage.

15. Apparatus according to claim 1, in combination with said lighting system, wherein said lighting system includes:

at least one negative resistance load.

16. Apparatus according to claim 1, in combination with said lighting system, wherein said lighting system includes:

at least one incandescent lamp.

* * * * *